United States Patent [19]

Kato et al.

[11] Patent Number: 4,832,117

[45] Date of Patent: May 23, 1989

[54] FIN TUBE HEAT EXCHANGER

[75] Inventors: Kaoru Kato, Otsu; Hachiro Koma, Kusatsu; Masashi Kawai, Kyoto, all of Japan

[73] Assignee: Matsushita Refrigeration Company, Osaka, Japan

[21] Appl. No.: 147,342

[22] Filed: Jan. 22, 1988

[30] Foreign Application Priority Data

Jan. 23, 1987 [JP] Japan ..... 62-14734

[51] Int. Cl.[4] ..... F28D 1/04

[52] U.S. Cl. ..... 165/151; 165/182

[58] Field of Search ..... 165/151, 181, 182

[56] References Cited

U.S. PATENT DOCUMENTS 3,135,320 6/1964 Forgó ..... 165/151
4,434,844 3/1984 Sakitani et al. ..... 165/151
4,723,600 2/1988 Yokoyama et al. ..... 165/151

FOREIGN PATENT DOCUMENTS 57-82690 5/1982 Japan ..... 165/151
61-21358 5/1986 Japan .
62-38152 9/1987 Japan .

*Primary Examiner*—Samuel Scott
*Assistant Examiner*—Allen J. Flanigan
*Attorney, Agent, or Firm*—Wenderoth, Lind & Ponack

[57] ABSTRACT

A fin tube heat exchanger is internally provided with a plurality of plate-shaped and regularly spaced fin members, a plurality of heat exchanger tubes inserted into through-holes defined in each fin member and a plurality of raised pieces formed in each fin member in a plurality of rows. The raised pieces in the same row are raised from a fin base in a direction opposite to the direction in which the raised pieces in adjacent rows are raised. The number of the raised pieces in each row is gradually increased as their row is located farther from a common center line of the through-holes. The raised pieces are integrally formed with and raised from the fin base between adjacent heat exchanger tubes so that two slits defined between the fin base and each raised piece may be open against the air flow.

14 Claims, 2 Drawing Sheets

FIN TUBE HEAT EXCHANGER

BACKGROUND OF THE INVENTION

1. Field of the Invention

The present invention generally relates to a heat exchanger for exchanging heat between two fluids, for example, between a refrigeration medium and air or the like, and more particularly, to a fin tube heat exchanger for use in an air conditioner, a refrigerator or the like.

2. Description of the Prior Art

Recently, air conditioners tend to be reduced in size or to be thin. A fin tube heat exchanger is occasionally employed in the air conditioner, and therefore, there has been an increased demand for higher performance thereof.

FIGS. 1 and 2 illustrate one of the conventional fin tube heat exchangers.

A plate-shaped fin, generally shown by 1, is provided with a plurality of fin collars 2 extending from a fin base and spaced from each other at regular intervals and a plurality of raised pieces 1*a* formed between the collars 2 on the same face of the fin base as the fin collars 2 are formed. The raised pieces 1*a* extend from the base plate up to the same height to prevent a temperature boundary layer from growing. A plurality of openings are defined between the fin base and the raised pieces 1*a* to permit an air flow A to pass therethrough. A plurality of heat exchanger tubes 3 extend through the fin collars 2 and are enlarged so as to be rigidly secured therein. Two tubes 3 are coupled to each other in the form of a figure "U" through a bend. When the air flow A passes between the tubes 3, an area 4*a* or 4*b* called "dead water region" upon which the air flow A hardly exerts any influence appears behind each tube 3 in a direction of the air flow A.

In the above described construction, all the raised pieces 1a are of the same configuration and are aligned in several rows in the direction of the air flow A. Accordingly, since the distance between adjacent raised pieces 1a is relatively small, they exert less influence upon the temperature boundary layer. Furthermore, leg portions of the raised pieces 1*a* are formed in a direction normal to a front edge of the fin 1. Because of this, the raised pieces 1*a* neither change the direction of the air flow A nor effectively turn it into turbulent flow. Thus, the dead water regions 4*a* and 4*b* become large and this fact reduces an effective heat transfer area. Since the leg portions of the raised pieces 1a are formed one behind another in the direction of the air flow A, resistance against the flow is concentrated, with the result that it is impossible to uniformly distribute the velocity of air flow A. The aforementioned conventional fin tube heat exchanger is, therefore, disadvantageous in that the raised pieces 1*a* can not be effectively utilized.

SUMMARY OF THE INVENTION

Accordingly, the present invention has been developed with a view towards substantially eliminating the above described disadvantage inherent in the prior art fin tube heat exchanger, and has for its essential object to provide an improved fin tube heat exchanger which has stable fin efficiency by lengthening a distance between each raised piece and a front edge of each fin member in a direction of an air flow so that the raised pieces may exert considerable influence upon a temperature boundary layer.

Another important object of the present invention is to provide a fin tube heat exchanger of the above described type which extends an effective heat transfer area by effectually converting the air flow into a turbulent flow so that the air flow may reach behind heat exchanger tubes to reduce dead water regions.

A further object of the present invention is to provide a high-performance fin tube heat exchanger which is remarkably raised in heat transfer efficiency by dispersing resistance against the flow so that the velocity of air flow may be unified between heat exchanger tubes and between plate-shaped fins.

In accomplishing these and other objects, according to one preferred embodiment of the present invention, there is provided a fin tube heat exchanger having therein a plurality of plate-shaped and regularly spaced fin members, a plurality of heat exchanger tubes inserted into through-holes defined in each fin member and a plurality of raised pieces formed in each fin member in a plurality of rows, with the raised pieces in the same row being raised from a fin base in a direction opposite to the direction in which the raised pieces in adjacent rows are raised. The number of the raised pieces in each row is increased as the row thereof is located farther from a common center line of the through-holes. The raised pieces are integrally formed with the fin base and are raised therefrom between adjacent heat exchanger tubes so that two slits defined between the fin base and each raised piece may be open against the air flow. Since each raised piece has two leg portions connecting it to the fin base, a great number of the leg portions connecting are provided in each fin member. Furthermore, since the raised pieces are formed in the above described fashion, the distance between each raised piece and a front edge of each fin member is caused to be longer as compared with that in the conventional fin tube heat exchanger.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 3:
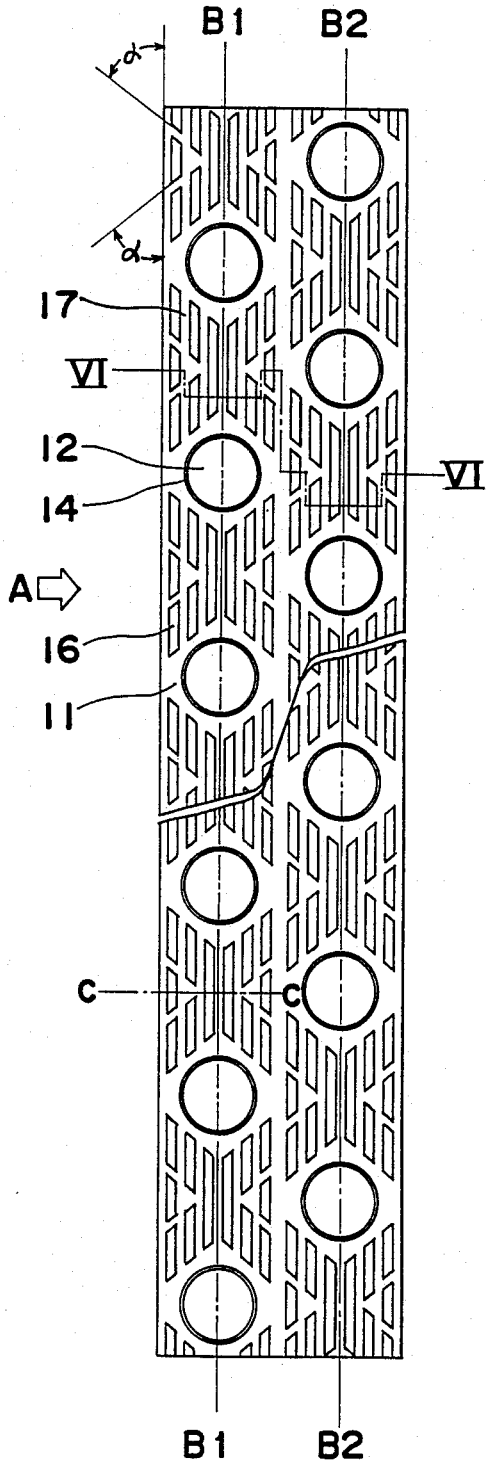
FIG. 3 is a fragmentary side elevational view of a fin tube heat exchanger according to one preferred embodiment of the present invention.

Referring first to FIG. 3, a fin tube heat exchanger is internally provided with a plurality of rectangular fins 11 of aluminum thin plates spaced at regular intervals in parallel with one another. Two rows of a plurality of regularly spaced through-holes 12, each of which receive therein a heat exchanger tube 13, are formed in each plate-shape fin 11 along its longitudinal direction.

The through-holes 12 of the rear row are offset from and located between those 12 of the front row in a direction of air flow A. A cylindrical fin collar 14 is integrally formed with the fin 11 around each through-hole 12 so that heat transfer between the tubes 13 and the fin 11 can be effectively conducted. The air flow A flows between the plate-shaped fins 11 constituting a fin assembly. The tubes 13 are inserted into the through-holes 12 in a direction perpendicular to the fin assembly. Upon insertion of the tubes 13, the tubes 13 are enlarged so as to be brought into close contact with the inner surfaces of the fin collars 14.

Figure 1:
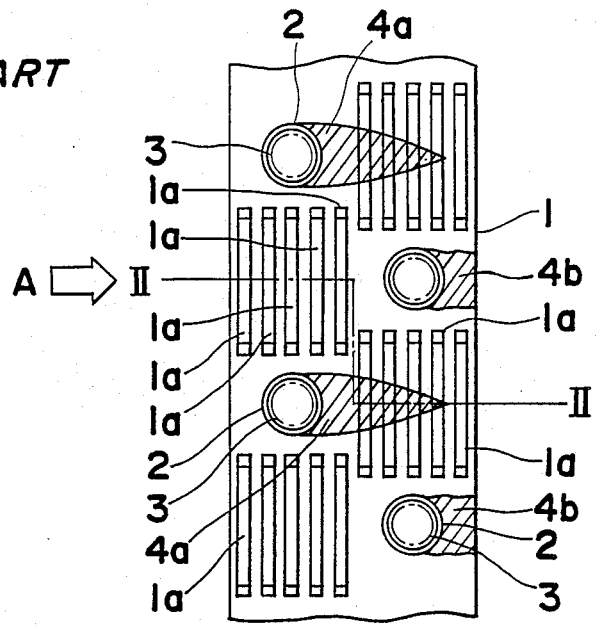
Fig. 1 PRIOR ART
FIG. 1 is a fragmentary side elevational view of a conventional fin tube heat exchanger.
Figure 2:
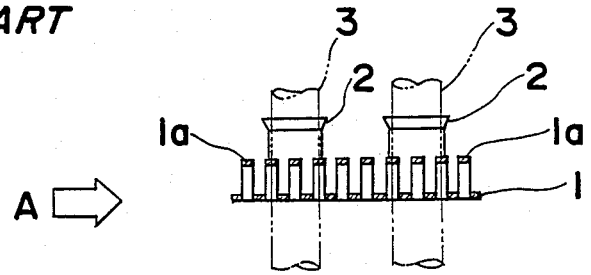
Fig. 2 PRIOR ART
FIG. 2 is a section taken along the line II—II in FIG. 1.
Figure 6:
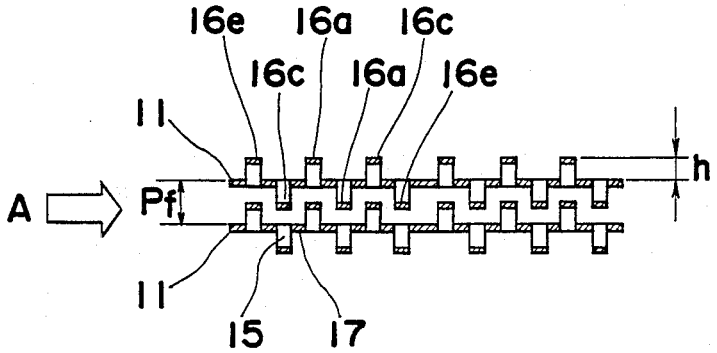
FIG. 6 is a section of a fin assembly, taken along the line VI—VI in FIG. 3.
Figure 5:
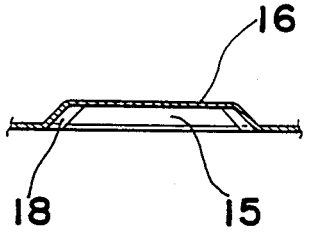
FIG. 5 is an enlarged section of one of raised pieces, taken along the line V—V in FIG. 4.

As shown in FIGS. 5 and 6, a large number of cut and raised pieces 16 are formed in each fin 11 between the through-holes 12 so that two slits 15 formed between each raised piece 16 and a fin base 17 may be open against the air flow. The raised pieces 16 are aligned in a plurality of rows in a direction perpendicular to the air flow A. The raised pieces 16 in the same row are raised from the fin base 17 in a direction opposite to the direction in which those 16 in adjacent rows are raised. The raised pieces 16 are formed in a manner such that every three rows thereof are symmetrically lined up on both sides of the center line B1—B1 or B2—B2 of the through-holes 12 in the same row. The raised pieces 16 become larger in number as their location becomes more distant from the center line B1—B1 or B2—B2. More specifically, when the row of the raised pieces 16 nearest to the center line B1—B1 or B2—B2 is regarded as the first row, one raised piece 16*a* in the first row is formed between the adjacent two through-holes 12. As to the second and third rows, two raised pieces 16*b* and 16*c* and three raised pieces 16*d*, 16*e* and 16*f* are provided between two adjacent through-holes 12. respectively. The raised pieces 16 in one row are different in size from those 16 in any other row. That is, the raised piece 16*a* in the first row is the largest and the raised pieces 16*d*, 16*e* or 16*f* in the third row are the smallest. However, total size of the raised pieces 16*a* in the first row is smaller than that in any other row, whereas the total size of the raised pieces in the third row is the largest. Accordingly, the raised pieces 16 between two adjacent through-holes 12 are provided in the form of a figure "X" as a whole, excepting the raised pieces 16*e* located at the center in the third row.

Figure 4:
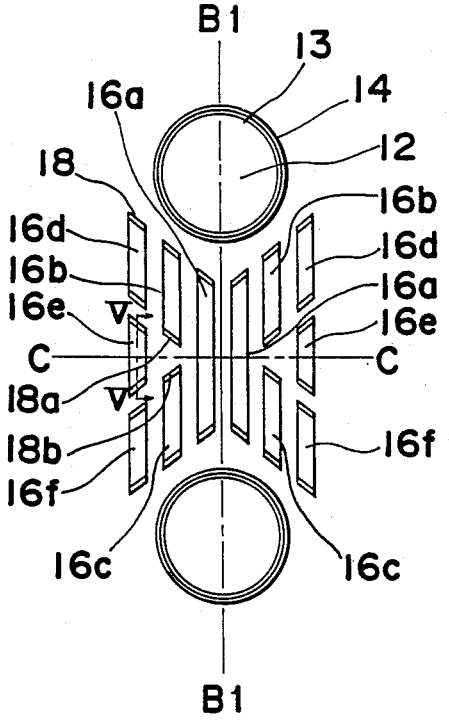
FIG. 4 is an enlarged detail of a main portion of FIG. 3.

As shown in FIGS. 3 and 4, opposite leg portions 18 of each raised piece 16 extending from the fin base 17 are inclined by a predetermined angle $\alpha$ with respect to the front edge of the fin 11. In other words, all the leg portions 18 are formed obliquely in a direction of the air flow A. The leg portions 18 located on one side with respect to a center line C—C of an air passage defined between the through-holes 12 are inclined in a direction opposite to the direction in which those 18 located on the other side are inclined. In connection with this, a detailed explanation will be made hereinafter with respect to the leg portions 18*a* and 18*b* of the raised pieces 16*b* and 16*c* in the second row, which leg portions 18*a* and 18*b* are located adjacent to each other in the vicinity of the center line C—C of the air passage. Those leg portions 18*a* and 18*b* located upstream with respect to the center line B1—B1 or B2—B2 of the through-holes 12 are inclined in a manner such that the distance therebetween is gradually reduced in the direction of the air flow A. On the contrary, the leg portions 18*a* and 18*b* located downstream are inclined in a manner such that the distance therebetween is gradually increased in the direction of the air flow A. The center line of each raised piece 16*e* located at the center of the third row coincides with the center line C—C of the air passage, and opposite leg portions 18 thereof are inclined similarly as the aforementioned leg portions 18*a* and 18*b*.

The height h of the raised pieces 16 is approximately half of a pitch Pf between two adjacent fins 11.

Since a great number of raised pieces 16 extending from the fin base 17 are formed in the above described fashion, the distance the air travels between any raised piece 16 and the front edge of the fin 11 in the direction of the air flow A becomes longer and the fin efficiency can be raised.

Moreover, because of the fact that all the leg portions 18 connecting the raised pieces 16 and the fin 11 are inclined by a predetermined angle with respect to the front edge of the fin 11, an eddy is liable to take place in the vicinity of each leg portion 18 to effectively produce a turbulent flow.

In addition, the raised pieces 16 are provided substantially in the pattern of an "X" as a whole, and the leg portions 18 thereof are inclined in opposite directions on respective sides of the center line C—C of the air passage so that the resistance thereof against the air flow A may become large, particularly at the central portion of the air passage. Accordingly, the air flow A is unified in velocity at various locations of the air passage so as to reach an area behind each tube 13, with the result that a dead water region arising behind each tube 13 can be reduced and an effective heat transfer area can be, therefore, increased. The velocity of air flow A is also unified by the raised pieces 16 uniformly formed between adjacent fins 11, since the height h of the raised pieces 16 is caused to be substantially equal to half of the pitch Pf between the fins 11. As a result, the amount of air passing the raised pieces 16 increases and this fact exerts considerable influence upon the temperature boundary layer and promotes the production of turbulent flow. Furthermore, since the leg portions 18 are formed so as not to overlap one another in the direction of air flow A, the eddy is liable to take place in the vicinity of each leg portion 18 without being influenced by other leg portions 18 located upstream. Between the tubes 13, the resistance against the air flow A is dispersed so that the velocity of air flow A may be further unified.

From the foregoing, the fin tube heat exchanger of the present invention prevents the temperature boundary layer from growing up, raises the fin efficiency, promotes the production of turbulent flow, reduces the dead water region and unifies the velocity of air flow, thus remarkably raising the heat transfer performance. Furthermore, since a great number of the raised pieces are integrally formed with the fin base, the plate-shaped fin 11 can be desirably raised in strength.

Accordingly, a high-performance fin tube heat exchanger of a small size can be obtained by the present invention.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A fin tube heat exchanger comprising:

fin assembly of a plurality of plate-shaped elongated fin members spaced at regular intervals in parallel with one another, each fin member having a fin base and defining therein a plurality of through-holes in at least one row in a longitudinal direction of the fin member;

a plurality of heat exchanger tubes inserted into said through-holes in a direction perpendicular to said fin assembly; and a plurality of raised pieces formed in each fin member in a plurality of rows in a direction perpendicular to an air flow passing through between said fin members, said raised pieces in the same row being raised from said fin base in a direction opposite to the direction in which said raised pieces in adjacent rows are raised, said raised pieces in one row near to a longitudinal fin edge being increased in number as compared with those in another row near to a center line of the row of through-holes, said fin base and each raised piece defining therebetween two openings open against the air flow, the number of said raised pieces in one row being increased from the row near to said center line of the through-holes towards another row near to said longitudinal fin edge, such that between adjacent through-holes, one, two and three raised pieces are formed in the first row nearest to said center line of the through-holes, in the second row and in the third row, respectively.

2. A fin tube heat exchanger as claimed in claim 1, wherein each raised piece has two leg portions for connecting said raised piece to said fin base, said leg portions being formed so as not to overlap one another in a direction of the air flow.

3. A fin tube heat exchanger as claimed in claim 1, wherein the height of said raised pieces is approximately half of a distance between adjacent fin members.

4. A fin tube heat exchanger as claimed in claim 1, wherein each raised raised piece has two leg portions for connecting said raised piece to said fin base, said leg portions being inclined by a predetermined angle with respect to a longitudinal front edge of said fin member.

5. A fin tube heat exchanger as claimed in claim 4, wherein said leg portions located on one side with respect to a center line of an air passage defined between said through-holes are inclined in a direction opposite to the direction in which said leg portions located on the other side are inclined.

6. A fin tube heat exchanger as claimed in claim 7, wherein the height of said raised pieces is approximately half of a distance between adjacent fin members.

7. A fin tube heat exchanger comprising:

fin assembly of a plurality of plate-shaped elongated fin members spaced at regular intervals in parallel with one another, each fin member having a fin base and defining therein a plurality of through-holes in at least one row in a longitudinal direction of the fin member;

a plurality of heat exchanger tubes inserted into said through-holes in a direction perpendicular to said fin assembly; and a plurality of raised pieces formed between adjacent through-holes in each fin member in a manner such that a plurality of rows of said raised pieces are symmetrically provided on respective sides of a center line of the row of said through-holes in a direction perpendicular to an air flow passing through between said fin members, said raised pieces in the same row being raised from said fin base in a direction opposite to the direction in which said raised pieces in adjacent rows are raised, said raised pieces in one row being increased in number from said center line of the through-holes towards upstream and downstream sides, said fin base and each raised piece defining therebetween two openings open against the air flow, such that between adjacent through-holes, one raised piece is formed in the first row nearest to said center line of the through-holes on each side thereof, with the number of said raised pieces being increased one by one as the row thereof is located farther from said center line of the through-holes on each side thereof.

8. A fin tube heat exchanger as claimed in claim 7, wherein each raised piece has two leg portions for connecting said raised piece to said fin base, said leg portions being formed so as not to overlap one another in a direction of the air flow.

9. A fin tube heat exchanger as claimed in claim 7, wherein each raised piece has two leg portions for connecting said raised piece to said fin base, said leg portions being inclined by a predetermined angle with respect to a longitudinal front edge of said fin member.

10. A fin tube heat exchanger as claimed in claim 9, wherein said leg portions located on one side with respect to a center line of an air passage defined between said through-holes are inclined in a direction opposite to the direction in which said leg portions located on the other side are inclined.

11. A fin tube heat exchanger as claimed in claim 10, wherein two raised pieces are provided, in a predetermined row between said through-holes, symmetrically on respective sides of said center line of the air passage, said leg portions located adjacent to each other in the vicinity of said center line of the air passage being inclined in a manner such that a distance therebetween is gradually reduced and increased in a direction of the air flow, respectively on upstream and downstream sides with respect to the center line of said through-holes.

12. A fin tube heat exchanger comprising:

fin assembly of a plurality of plate-shaped elongated fin members spaced at regular intervals in parallel with one another, each fin member having a fin base and defining therein a plurality of through-holes in two rows in a longitudinal direction of the fin member, said through-holes in a rear row being formed between those in a front row;

a plurality of heat exchanger tubes inserted into said through-holes in a direction perpendicular to said fin assembly; and a plurality of raised pieces formed between adjacent through-holes in the same row in each fin member in a manner such that a plurality of rows of said raised pieces are symmetrically provided on respective sides of a center line of said through-holes in the same row in a direction perpendicular to an air flow passing through between said fin members, said raised pieces in the same row being raised from said fin base in a direction opposite to the direction in which said raised pieces in adjacent rows are raised, said raised pieces in one row being increased in number from said center line of the through-holes towards upstream and downstream sides, said fin base and each raised piece defining therebetween two openings open against the air flow, such that between adjacent through-holes in the same row, one raised piece is formed in the first row thereof nearest to said center line of the through-holes on each side thereof, with the number of said raised pieces being increased one by one as the row thereof is located farther from said center line of the through-holes on each side thereof.

13. A fin tube heat exchanger comprising:

fin assembly of a plurality of plate-shaped elongated fin members spaced at regular intervals in parallel with one another, each fin member having a fin base and defining therein a plurality of through-holes in at least one row in a longitudinal direction of the fin member;

a plurality of heat exchanger tubes inserted into said through-holes in a direction perpendicular to said fin assembly; and a plurality of raised pieces, each of which has two leg portions for connecting the raised piece to the fin base, formed in each fin member in a plurality of rows in a direction perpendicular to an air flow passing through between said fin members, said raised pieces in the same row being raised from said fin base in a direction opposite to the direction in which said raised pieces in adjacent rows are raised, the number of said raised pieces in each of said rows increasing as each row is located further from a center line of the row of through-holes towards a longitudinal fin edge of the fin member, said fin base and each raised piece defining therebetween two openings open against the air flow, such that two raised pieces are provided, in a predetermined row between said through-holes in the same row, symmetrically on respective sides of a center line of an air passage defined between said through-holes, said leg portions of the two raised portions located adjacent to each other in the vicinity of said center line of the air passage being inclined in a manner such that a distance therebetween is gradually reduced and increased in a direction of the air flow, respectively on upstream and downstream sides with respect to the center line of said through-holes.

14. A fin tube heat exchanger as claimed in claim , wherein the height of said raised pieces is approximately half of a distance between adjacent fin members.

* * * * *